US009945079B2

(12) United States Patent
Ganz

(10) Patent No.: US 9,945,079 B2
(45) Date of Patent: Apr. 17, 2018

(54) MACHINE FOR RENEWAL OF SLEEPERS AND BALLAST UNDER RAISED RAILWAY TRACK

(71) Applicants: MATISA MATERIEL INDUSTRIEL SA, Crissier-Lausanne (CH); Jörg Ganz, Etoy (CH)

(72) Inventor: Joerg Ganz, Etoy (CH)

(73) Assignees: MATIS Material Industrial SA, Crissier-Lausanne (CH); Joerg Ganz, Etoy (CH)

( * ) Notice: Subject to any disclaimer, the term of this patent is extended or adjusted under 35 U.S.C. 154(b) by 118 days.

(21) Appl. No.: 14/911,803

(22) PCT Filed: Jul. 31, 2014

(86) PCT No.: PCT/EP2014/002106
§ 371 (c)(1),
(2) Date: Feb. 12, 2016

(87) PCT Pub. No.: WO2015/024626
PCT Pub. Date: Feb. 26, 2015

(65) Prior Publication Data

US 2016/0194836 A1 Jul. 7, 2016

(30) Foreign Application Priority Data

Aug. 20, 2013 (CH) ..... 1423/13

(51) Int. Cl.
*E01B 29/10* (2006.01)
*E01B 27/10* (2006.01)
(Continued)

(52) U.S. Cl.
CPC ..... *E01B 29/10* (2013.01); *E01B 27/105* (2013.01); *E01B 27/11* (2013.01); *E01B 29/09* (2013.01);
(Continued)

(58) Field of Classification Search
CPC ..... E01B 29/10; E01B 29/09; E01B 27/105; E01B 27/11; E01B 2203/02; E01B 2203/062
(Continued)

(56) References Cited

U.S. PATENT DOCUMENTS 3,691,957 A * 9/1972 Plasser ..... E01B 29/04 104/9
3,699,894 A * 10/1972 Plasser ..... E01B 29/05 104/2
(Continued)

FOREIGN PATENT DOCUMENTS

AT 380708 B 6/1986
DE 202004004007 U1 5/2004
(Continued)

*Primary Examiner* — Jason C Smith
(74) *Attorney, Agent, or Firm* — Laurence A. Greenberg; Werner H. Stemer; Ralph E. Locher

(57) ABSTRACT

A machine for the renewal of sleepers of a track having rails and for the cleaning of exposed ballast after removal of old sleepers, includes a machine frame which is movable on a rail bogie on the track, a screening plant and a clearing device having a collection device for collecting ballast. A sleeper transport device includes a sleeper gripper, rotatable about a vertical axis, between two end-positioned rail bogies, connected to the machine frame, and being displaceable in a longitudinal direction of the machine. The sleeper transport device is displaceable from a front end position (with respect to a working direction) provided for picking up new sleepers by the collection device for collecting ballast, to a rear end position configured to deposit the new sleepers.

4 Claims, 2 Drawing Sheets

(51) Int. Cl.
*E01B 27/11* (2006.01)
*E01B 29/09* (2006.01)

(52) U.S. Cl.
CPC ..... *E01B 2203/02* (2013.01); *E01B 2203/062* (2013.01)

(58) Field of Classification Search
USPC ..... 104/2, 9
See application file for complete search history.

(56) References Cited

U.S. PATENT DOCUMENTS

| | | | | | |
|---|---|---|---|---|---|
| 3,850,251 | A * | 11/1974 | Plasser | E01B 27/10 | 104/7.2 |
| 4,152,989 | A * | 5/1979 | Theurer | E01B 27/08 | 104/2 |
| 4,186,804 | A * | 2/1980 | Theurer | E01B 27/04 | 104/7.1 |
| 4,355,687 | A * | 10/1982 | Theurer | E01B 27/02 | 104/7.3 |
| 4,611,541 | A * | 9/1986 | Theurer | E01B 27/105 | 104/2 |
| 4,878,435 | A * | 11/1989 | Theurer | E01B 29/06 | 104/137 |
| 4,955,301 | A * | 9/1990 | Theurer | E01B 29/10 | 104/7.2 |
| 4,955,302 | A * | 9/1990 | Theurer | E01B 29/10 | 104/7.2 |
| 5,046,270 | A * | 9/1991 | Theurer | E01B 29/06 | 104/7.2 |
| 5,063,856 | A * | 11/1991 | Theurer | E01B 29/32 | 104/7.1 |
| 5,347,933 | A * | 9/1994 | Mathison | E01B 27/10 | 104/2 |
| 5,502,904 | A * | 4/1996 | Theurer | E01B 27/102 | 104/2 |
| 6,209,462 | B1 * | 4/2001 | Theurer | E01B 27/04 | 104/2 |
| 6,477,960 | B2 * | 11/2002 | Theurer | E01B 29/06 | 104/2 |
| 9,021,724 | B2 * | 5/2015 | Svitok | E01B 27/04 | 104/7.3 |
| 2016/0194836 | A1 * | 7/2016 | Ganz | E01B 27/105 | 104/9 |

FOREIGN PATENT DOCUMENTS

| | | | |
|---|---|---|---|
| EP | 0057128 | A1 | 8/1982 |
| EP | 1179635 | A2 | 2/2002 |
| EP | 2431522 | A1 | 3/2012 |
| FR | 2917101 | A1 | 12/2008 |
| WO | 2012095152 | A1 | 7/2012 |

* cited by examiner

Fig. 3
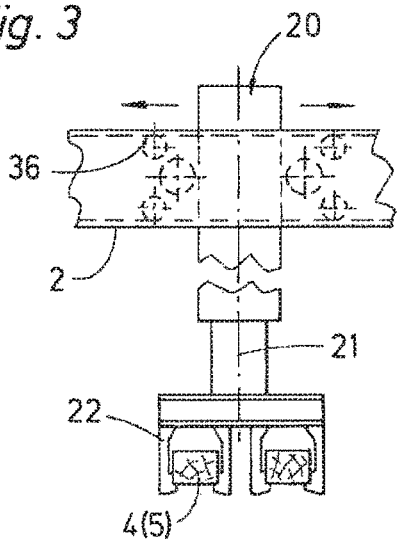
Fig. 4
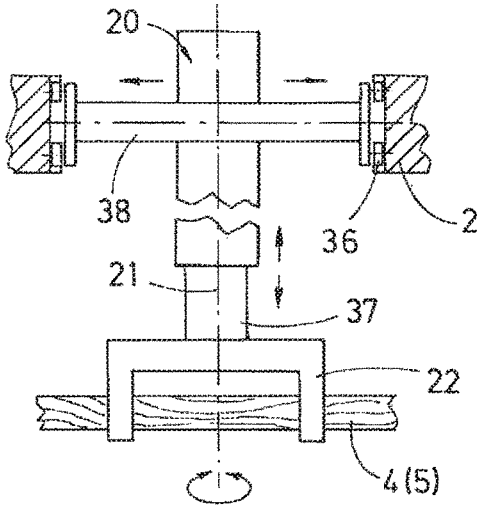
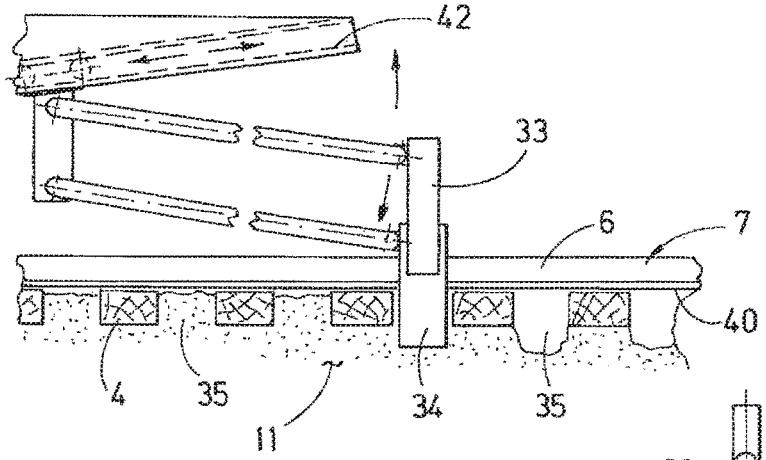
Fig. 5
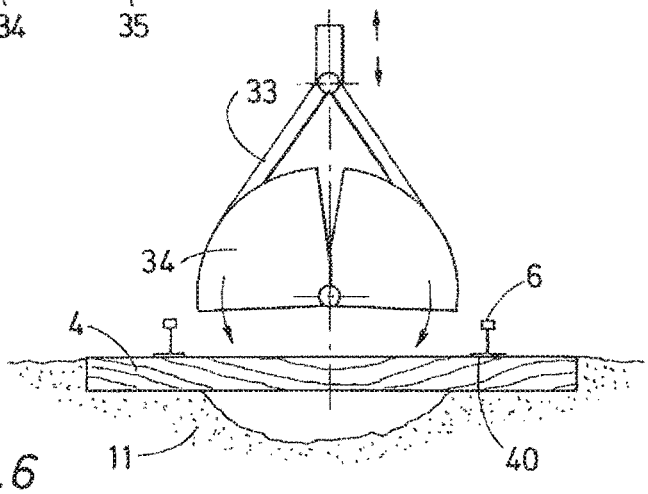
Fig. 6

MACHINE FOR RENEWAL OF SLEEPERS AND BALLAST UNDER RAISED RAILWAY TRACK

BACKGROUND OF THE INVENTION

Field of the Invention

The invention relates to a machine for the renewal of sleepers of a railway track, and for cleaning of ballast exposed after removal of the old sleepers.

From AT 380 708 B is known a machine for cleaning ballast, which is movable via running gears on a track. When the machine encounters an obstacle next to the track, which hampers the excavating chain during the continuous working movement forwards, then a number of sleepers in the area of the obstacle are released and temporarily laid by the side of the track. After working through this area with the excavating chain the removed sleepers are reinserted and reconnected to the rails.

EP 0 057 128 B1 discloses a machine for the renewal of sleepers of a track, wherein the old sleepers are removed in a direction perpendicular to the track by means of gripping members that are adjustable in height, and length as well as perpendicularly to the track. A gripping member is designed to pivot around a vertical axis and may thus rotate the gripped sleeper by a quarter turn with respect to the track parallel with the track longitudinal direction.

Other machines are known from FR 2 917 101 A1, DE 20 2004 004 007 U1, WO 2012/095152 A1, EP 1 179 635 A2 and EP 2 431 522 A1.

BRIEF SUMMARY OF THE INVENTION

The object of the present invention is to provide a machine of the type mentioned, wherein the work may be effected even in restricted space worksites.

This object is achieved according to the invention with a machine for the renewal of sleepers of a track having rails, and for the cleaning of the exposed ballast after removal of the old sleepers, wherein the machine includes a machine frame which is movable on a rail bogie on the track, a screening plant and a clearing device having a collection device for collecting ballast. A sleeper transport device having a sleeper gripper, rotatable about a vertical axis, is provided between the two end-positioned rail bogies, connected to the machine frame, and is displaceable in a machine-longitudinal direction. The sleeper transport device is displaceable from a front (with respect to a working direction) end position provided for the storage of new sleepers via the collection device for collecting ballast, to a rear end position configured to store the new sleepers.

With the features according to the invention, it is now possible to achieve satisfactory and efficient work results by combining sleeper interchange with ballast cleaning even in particularly spatially restricted conditions, such as between platforms, in tunnels or on bridges, wherein the excavating chain underneath the machine is used in an area where there are temporarily no sleepers affecting the freedom of movement of the chain. Thus, the excavating chain may be positioned very close to the rails or even applied against them, wherein they are able work effectively despite a lack of space.

Further advantages of the invention will become apparent from the dependent claims and the drawing description.

BRIEF DESCRIPTION OF THE SEVERAL VIEWS OF THE DRAWING

The invention will be described in greater detail using an exemplary embodiment illustrated in the figures as follows:

FIGS. 1 and 2 show a side view of an inventive machine (shown in two parts for a better overview), while FIGS. 3 and 4 or 5 and 6 show a side and front view of a sleeper transport device and/or a ballast excavation device.

DESCRIPTION OF THE INVENTION

Figure 1:
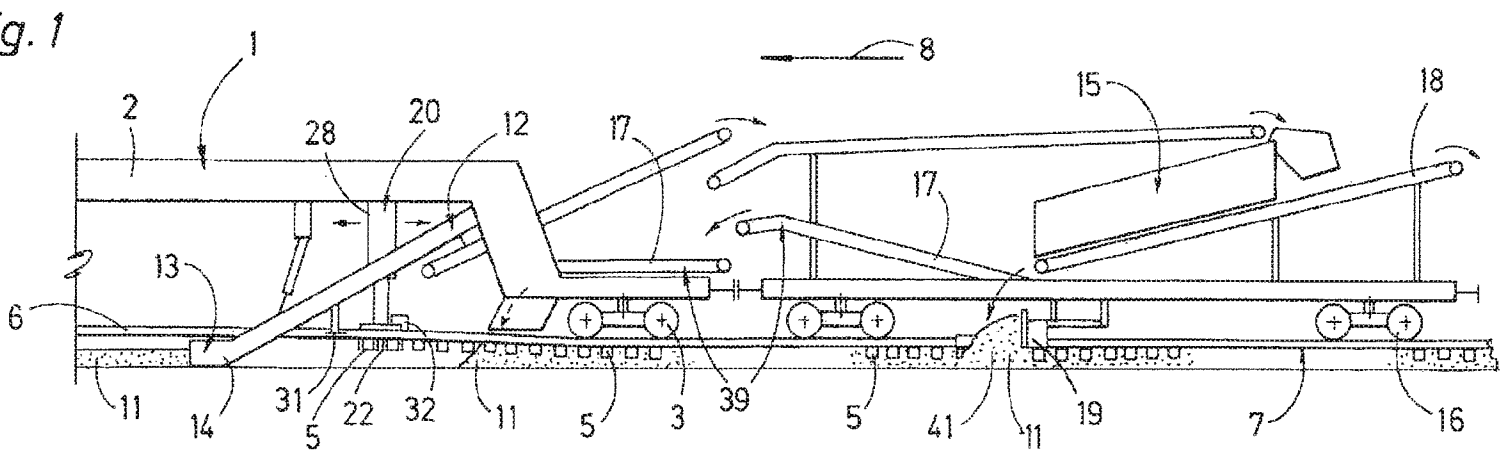
Figure 2:
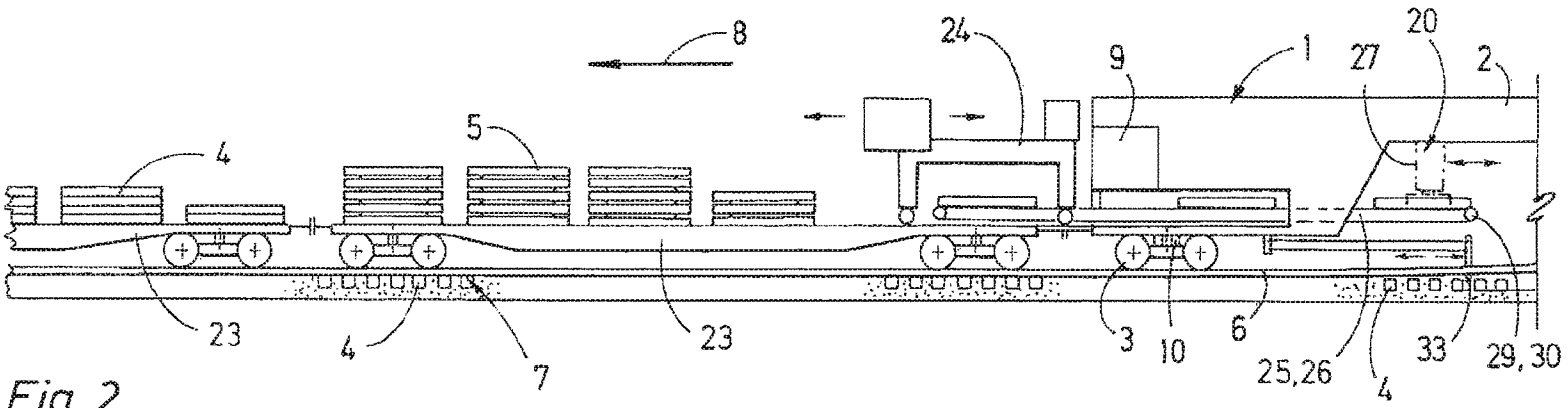

The machine shown in FIGS. 1 and 2 comprises a machine frame 2, which may be moved to the end of the rail bogie 3 in the working direction 8 of the track 7 comprising the sleepers 4 or 5 and rails 6. A power source 9 is used to supply power to a driving gear 10 as well as working units of the machine 1 which are described in more detail below.

The machine 1 is designed for the renewal of sleepers of the track 7 as well as for cleaning the exposed ballast 11 after removal of the old sleepers 4, and comprises a clearing device 12 with a collection device 13 in the form of an endless excavating chain 14 guided around the track 7 to collect the ballast, as well as a screening plant 15. This is mounted on its own bogie 16 coupled to the machine frame 2 and comprises a return device 39 with conveyor belts 17 for returning the cleaned ballast 11, a scooping conveyor belt 18, and a ballast grading device 19.

A sleeper transport device 20 is provided between the two rail bogies 3 positioned at the ends (visible in more detail in FIGS. 3 and 4), and is connected to the machine frame 2 via a roller guide 36 that is displaceable in the machine longitudinal direction, and to a sleeper gripper 22 that is rotatable around a vertical axis 21 for the simultaneous gripping of two sleepers 4 or 5. (In one alternative, two sleeper grippers 22 may be provided in order to grip just a single sleeper 4, 5). The sleeper gripper 22 is designed to be adjustable in height by means of guide columns 37, 38, and laterally to the machine. The displacement path of the sleeper transport device 20 extends in the machine longitudinal direction from a front end position 27 (with respect to the working direction 8) that is designed to receive new sleepers 5 via the collection device 13 for collecting ballast, to a rear end position 28 for storing the new sleepers 5 (FIG. 1).

Furthermore, the machine 1 is connected at its front end in the working direction 8 (FIG. 2) to a sleeper wagon 23 for old and new sleepers 4, 5, which are conveyed to and fro by means of a gantry crane 24 in the machine longitudinal direction between the sleeper wagon 23 and an old sleeper transport unit 25 arranged on the machine frame 2 and a new sleeper transport unit 26 lying adjacent and parallel to each other. In the area of the front end position 27 of the sleeper transporting device 20, there is a first conveying end 29 of the new sleeper transport unit 26 and a second conveying end 30 of the old sleeper transport unit 25.

Rail lifting tongs 31 for lifting the rails 6 as well as a screwing unit 32 for connecting the new sleepers 5 with the raised rails 6, are fastened on the machine frame 2 in the rear end position 28 of the sleeper transport device 20.

FIGS. 5 and 6 further show a ballast excavation device 33 in the form of a height-adjustable and pivotable clamshell bucket unit 34 in the area below the conveying ends 29, 30, and which is adjustable in the machine longitudinal direction through a guide 42, by means of which the ballast 11 lying in the sleeper spaces 35 between the old sleepers 4 is removed prior to the collection of the old sleepers 4 in order to facilitate the picking up of these sleepers by the sleeper gripper 22.

In the course of the application of the invention, after loosening the rail fasteners, first the two rails 6 of the track 7 are raised by the rail lifting tongs 31 in order to distance them from the underlying sleepers 4. The ballast 11 in the sleeper spaces 35 between the old sleepers 4 is removed in the front area of the machine 1 by means of the ballast excavation device 33 with clamshell buckets 34 in order to facilitate the gripping and lifting of the old sleepers 4. These old sleepers 4 are now, individually or in pairs, picked up by the sleeper transport unit 20 and the sleeper gripper 22, then rotated through 90 degrees about the axis 21 into a position running in the longitudinal direction of the track, and lifted up between the raised rails 6. Then, after forward movement of the sleeper transport device 20 to its front end position 27, the old sleepers 4 are put down on the second conveyor end 30 of the old sleeper transport unit 25 and transferred to the front of the machine 1 in the working direction 8. Then the sleepers are further transported to a sleeper wagon 23 by means of the gantry crane 24, which also serves for the delivery of the new sleepers 5 from a new sleeper wagon 23 to the new sleeper transport unit 26.

The exposed ballast 11 is collected by the collection device 13 of the clearing device 12, along with the ballast which was collected in the meantime by the ballast excavation device 33 moving in the opposite direction to the working direction 8 in this area. The excavated ballast 11 is then fed to the screening facility 15 for cleaning and disposal of waste to the rear via the waste conveyor belt 18. The cleaned ballast 11 is partly deposited via the conveyor belts 17 of the return device 39 into the track 7 in front of the rear rail bogie 3 in order to form a support for the new sleepers 5.

The sleeper transporting unit 20 picks up new sleepers 5 from the first conveyor end 29 of the new sleeper transporting unit 26 in its forward end position 27 and transports them to the rear end position 28. Thereafter, the sleepers 5 positioned in the track longitudinal direction in the area between the collection device 13 and the return means 39 of the ballast 11, are lowered between the two raised rails 6 and then rotated through 90 degrees about the axis 21 into the lateral direction to the track and connected to a rail foot 40 of the raised rails 6 while pressing against these by means of the screwing units 32.

The rebuilt track 7 is ballasted with the remaining cleaned ballast 11 at a discharge point 41 under the screening plant 15, which ballast 11 may then be finally levelled and flattened by means of the ballast leveller 19. Following displacement of the sleeper transport device 20 to the front end position 27, a new cycle as just described begins.

The invention claimed is:

1. A machine for the renewal of sleepers of a track having rails and for the cleaning of exposed ballast after removal of old sleepers, the machine comprising:

a machine frame being movable on a rail bogie on the track defining a working direction;

a screening plant for screening ballast;

a clearing device having a collection device for collecting ballast; and a sleeper transport device being provided between two end-positioned rail bogies, being connected to said machine frame, being displaceable in a longitudinal direction of the machine and having a sleeper gripper for removing old sleepers as well as for positioning new sleepers and being rotatable about a vertical axis;

said sleeper transport device being displaceable from a front end position, relative to said working direction, for picking up new sleepers, over said collection device for collecting ballast, to a rear end position for depositing the new sleepers.

2. The machine according to claim 1, which further comprises a new sleeper transport device having a first conveyor end and an old sleeper transport device having a second conveyor end, said first conveyor end and said second conveyor end being disposed in a vicinity of said front end position of said sleeper transport device.

3. The machine according to claim 1, which further comprises a screwing unit fastened to said machine frame in a vicinity of said rear end position of said sleeper transport device for connecting the new sleepers to raised rails.

4. The machine according to claim 1, wherein said sleeper gripper is one of two sleeper grippers of said sleeper transport device being rotatable about said vertical axis.

* * * * *